US007726022B2

(12) United States Patent
Trbojevic et al.

(10) Patent No.: US 7,726,022 B2
(45) Date of Patent: Jun. 1, 2010

(54) METHOD OF DISMANTLING A PORTION OF A TURBOMACHINE

(75) Inventors: Bogdan Trbojevic, Karlovac (HR); Stevica Furdek, Duga Resa (HR); Urs Benz, Gipf-Oberfrick (CH); Anna Maria Olsson, Helsinborg (SE); Elisabetta Carrea, Zurich (CH)

(73) Assignee: ALSTOM Technology Ltd., Baden (CH)

( * ) Notice: Subject to any disclaimer, the term of this patent is extended or adjusted under 35 U.S.C. 154(b) by 354 days.

(21) Appl. No.: 11/623,778

(22) Filed: Jan. 17, 2007

(65) Prior Publication Data

US 2007/0175221 A1 Aug. 2, 2007

(30) Foreign Application Priority Data

Feb. 2, 2006 (DE) ..... 10 2006 004 785

(51) Int. Cl.
*B21K 25/00* (2006.01)
*F02C 7/20* (2006.01)

(52) U.S. Cl. ..... 29/889.2; 60/798; 60/752

(58) Field of Classification Search ..... 29/889.1, 29/889.2, 402.03, 426.1, 426.5; 60/752, 60/796, 798; 415/209.2, 213.1, 214.1, 126–128
See application file for complete search history.

(56) References Cited

U.S. PATENT DOCUMENTS 2,748,567 A * 6/1956 Dougherty ..... 60/798
3,031,844 A * 5/1962 Tomolonius ..... 60/752
3,628,884 A * 12/1971 Mierley, Sr. ..... 415/213.1
3,741,680 A * 6/1973 Killmann et al. ..... 415/214.1
5,779,442 A * 7/1998 Sexton et al. ..... 415/173.2
6,224,332 B1 * 5/2001 Leach et al. ..... 415/126
6,352,405 B1 * 3/2002 Tomko ..... 415/209.2
6,752,589 B2 * 6/2004 Vogan et al. ..... 415/103
2007/0041833 A1 * 2/2007 Dupin et al. ..... 415/214.1

* cited by examiner

*Primary Examiner*—David P Bryant
*Assistant Examiner*—Ryan J Walters
(74) *Attorney, Agent, or Firm*—Adam J. Cermak; Cermak Kenealy Vaidya &Nakajima LLP

(57) ABSTRACT

A method of dismantling a turbomachine includes opening a turbomachine casing in the region of a combustion chamber, releasing a top half shell from a bottom half shell, axially displacing the top half shell and thereafter removing the top half shell in essentially the radial direction, rotationally fixedly connecting an auxiliary tool to the rotor of the turbomachine, connecting the auxiliary tool to the bottom half shell via axially displaceable adapter slides arranged on said auxiliary tool, axially displacing the bottom half shell to release the bottom half shell from axial connecting contours, rotating the bottom half shell with the rotor by approximately 180° until the bottom half shell assumes essentially the position of the removed top half shell, and releasing the bottom half shell and removal of said bottom half shell.

4 Claims, 3 Drawing Sheets

METHOD OF DISMANTLING A PORTION OF A TURBOMACHINE

This application claims priority under 35 U.S.C. §119 to German application number 10 2006 004 785.0, filed 2 Feb. 2006, the entirety of which is incorporated by reference herein.

BACKGROUND OF THE INVENTION

1. Field of the Invention

The present invention relates to a turbomachine with a combustion chamber, in particular a gas turbine. The invention also relates to a method of dismantling an element of a turbomachine.

2. Brief Description of the Related Art

Turbomachines, such as gas turbines for example, are common nowadays in power plant technology and are economical, in particular when they run continuously. Firstly, prolonged downtimes and frequent start-up and shutdown of the turbine have an adverse effect on the service life of the turbine, since the material stress is especially high in particular during start-up and shutdown; secondly, prolonged downtimes, for example due to maintenance work, cause high costs or loss of income. In order to keep the material stress as low as possible on the one hand and the costs as low as possible on the other hand, it is attempted to use the turbomachines in continuous operation. Of course, temporary outage of the turbomachine on account of maintenance work to be carried out is unavoidable, although these downtimes should be as short as possible.

The extent to which the turbomachine is constructed for ease of maintenance, that is to say how simply and quickly it can be maintained, has a particular effect on the length of the downtimes. In this case, complicated and expensive constructions prolong the downtime and make the maintenance more expensive.

SUMMARY OF THE INVENTION

This is where the invention comes in. One of numerous aspects of the present invention deals with the problem of specifying, for a turbomachine of the aforementioned type, an embodiment which is distinguished by considerable ease of maintenance, in particular with regard to the combustion chamber components, and thus makes possible considerably reduced downtimes and consequently reduced maintenance costs.

Another aspect of the present invention is based on the general idea of constructing a turbomachine, having a combustion chamber, in such a way that, in the event of maintenance, access can be gained to its components simply and quickly for the purpose of inspection, maintenance, removal, and refitting of the components. To this end, a closable maintenance opening is provided on the housing at least in the region of the combustion chamber, which maintenance opening provides access to an outer carrier, an inner segment carrier, and a front plate. The outer carrier, the inner segment carrier, and the front plate together define the combustion chamber and are thus exposed to high temperatures. This thermal loading in turn necessitates regular maintenance, during which the operability of these parts is checked and the parts are renewed or exchanged, if need be. The outer carrier, the inner segment carrier, and the front plate are designed as annular shell elements which have a respective bottom half shell and a respective top half shell which can be connected thereto. In order to be able to assemble the outer carrier, the inner segment carrier, and the front plate in a simple and accurately fitting manner, they have axially acting connecting contours which permit simple and quick release, or connection of these parts by displacement in the axial direction. Due to the annular shell elements being divided into a respective bottom half shell and a respective top half shell which can be connected thereto, the half shells can be assembled and dismantled through the maintenance opening, provided on the top side for example, as a result of which the maintenance effort can be considerably reduced.

In a preferred exemplary embodiment of the solution according to the invention, at least one of the connecting contours is designed as an axially open circumferential groove or as a circumferential tongue interacting with this circumferential groove. The tongue-and-groove effect thus achieved firstly facilitates the dismantling or the assembly of the turbomachine and secondly ensures that the shell elements defining the combustion chamber are joined together in an accurately fitting manner. In addition, other connecting contours are also conceivable, in particular in the form of projections and recesses formed so as to be complementary to one another, which likewise offer the advantages just mentioned.

The top half shells are preferably designed in such a way that, for dismantling, they can be displaced axially and then removed radially relative to a rotor of the turbomachine. To dismantle the top half shells, it is therefore necessary to release the top half shell from the corresponding bottom half shell or from a casing, whereupon the top half shells can be axially displaced and thus the connecting contours can be released from one another. After the release of the axial connecting contours, the top half shells can be removed radially relative to the rotor, for example by means of a lifting tool. The top half shells are in this case assembled in the reverse sequence, so that they are first brought radially up close to the rotor and are displaced parallel to the rotor before reaching their final installation position in such a way that the connecting contours engage in one another or bear against one another in a positive-locking manner. This makes it possible to remove the top half shell in a simple manner, which in particular facilitates maintenance work.

In a further advantageous exemplary embodiment of the solution according to the invention, the bottom half shells are designed in such a way that, for their dismantling, they can be axially displaced and rotated upward about the rotor axis or with the rotor by means of an auxiliary tool which can be connected to the rotor in a rotationally fixed manner. After the dismantling of the top half shell, there is free access to the bottom half shell, whereupon the auxiliary tool can be connected on the one hand in a rotationally fixed manner to the rotor and on the other hand in a fixed manner to the bottom half shell. After any connecting means with which the bottom half shell is fastened to the casing and/or to another bottom half shell has been released, the bottom half shell can be displaced parallel to the rotor and thus out of the connecting contour, for example by means of two slides movably arranged on the auxiliary tool. After the displacement, the bottom half shell can be rotated upward with the rotor by about 180° and can then be removed in a simple manner with a lifting tool, for example a crane. By the rotor axis again being rotated by 180°, the auxiliary tool can in turn also be rotated upward and can be removed from the rotor after the connecting means between the auxiliary tool and the rotor have been released. The half shells mentioned may in this case be half shells of the front plate, of the outer carrier or of the inner segment carrier. The process for assembling or dismantling the two half shells is thereby greatly simplified overall.

Further important features and advantages of the turbomachine according to the invention follow from the drawings and from the associated description with reference to the drawings.

BRIEF DESCRIPTION OF THE DRAWINGS

Preferred exemplary embodiments of the invention are shown in the drawings and described in more detail below, the same reference numerals designating the same or similar or functionally identical components.

In the drawings, in each case in a highly schematic manner.

DETAILED DESCRIPTION OF EXEMPLARY EMBODIMENTS

Figure 1:
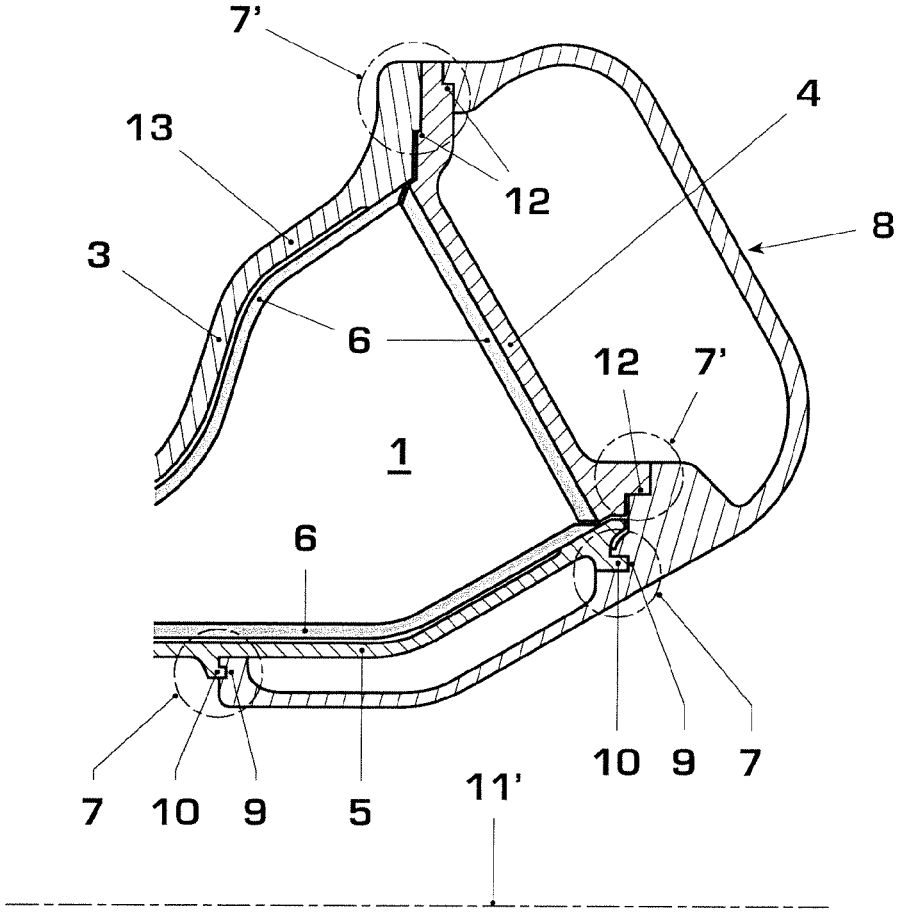
FIG. 1 shows a cross section through a combustion chamber.

According to FIG. 1, a combustion chamber 1 of a turbomachine 2 (otherwise not shown) has an outer carrier 3, a front plate 4 and an inner segment carrier 5. Both the outer carrier 3 and the front plate 4 and the inner segment carrier 5 are provided with a heat-resistant coating 6 toward the combustion chamber 1 and define the combustion chamber 1. In the regions marked with circles, the outer carrier 3, the inner segment carrier 5 and the front plate 4 are connected to one another and/or to a casing 8 in the assembled state via connecting contours 7 and 7', respectively, which are axially releasable from one another. The connecting contours 7 are symbolized by circles and may be designed in this case, for example, as axially open circumferential grooves 9 and as circumferential tongues 10 interacting with this circumferential groove 9. The expression "axially" means parallel to a rotor 11. In addition to a design of the one set of connecting contours 7 as grooves and tongues, it is also conceivable for the other connecting contours 7 to be designed, for example, as a step 12. A common feature of all the connecting contours 7 in this case is that they provide an axial connecting means between the outer carrier 3, the inner segment carrier 5 and the front plate 4 or the casing 8.

According to an exemplary embodiment of the invention, both the outer carrier 3 and the inner segment carrier 5 and the front plate 4 are designed as annular shell elements 13 which in each case have a bottom half shell 14 and a top half shell 15 which can be connected thereto (compare FIGS. 2 to 6). The top half shells 15 are designed here in such a way that, for dismantling, they can be displaced axially and then removed radially relative to the rotor 11 of the turbomachine 2. In contrast, the bottom half shells 14 are designed in such a way that, for their removal, they can be axially displaced and rotated upward with the rotor 11 by means of an auxiliary tool 16 (compare FIG. 4) which can be connected to the rotor 11 in a rotationally fixed manner.

A method of dismantling an element of a turbomachine 2 is to be explained in more detail below with reference to FIGS. 2 to 6.

Figure 2:
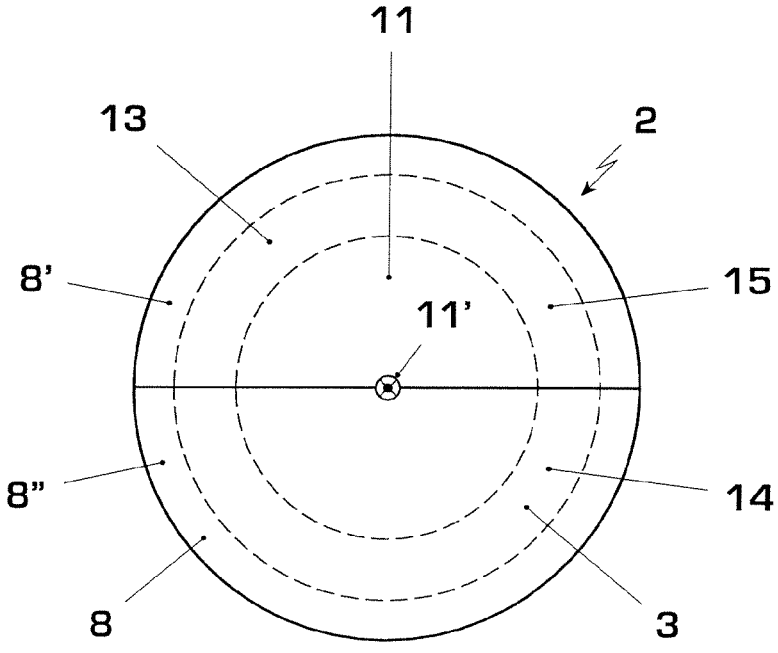
FIG. 2 shows an axial section of a turbomachine with closed casing.

Shown in FIG. 2 is an axial front view of a turbomachine 2 which is closed all around by the casing 8. To remove the outer carrier 3, first of all, according to FIG. 3, the casing 8 is opened in the region of the combustion chamber 1, so that access to the outer carrier 3 or its top half shell 15 is provided. In FIGS. 2 to 6, the rotor axis 11' or the rotor 11 is disposed perpendicularly to the image plane. Once access to the outer carrier 3 has been provided by removing a top casing half 8' or by opening a closable maintenance opening (not shown), the top half shell 15 can be released from the bottom half shell 14 and displaced axially, that is to say out of or into the image plane according to FIGS. 2 to 6. In the process, the axial displacement causes the connecting contours 7 to be moved apart, which release the top half shell 15 in the radial direction. After this release, removal is effected in essentially the radial direction.

Figure 4:
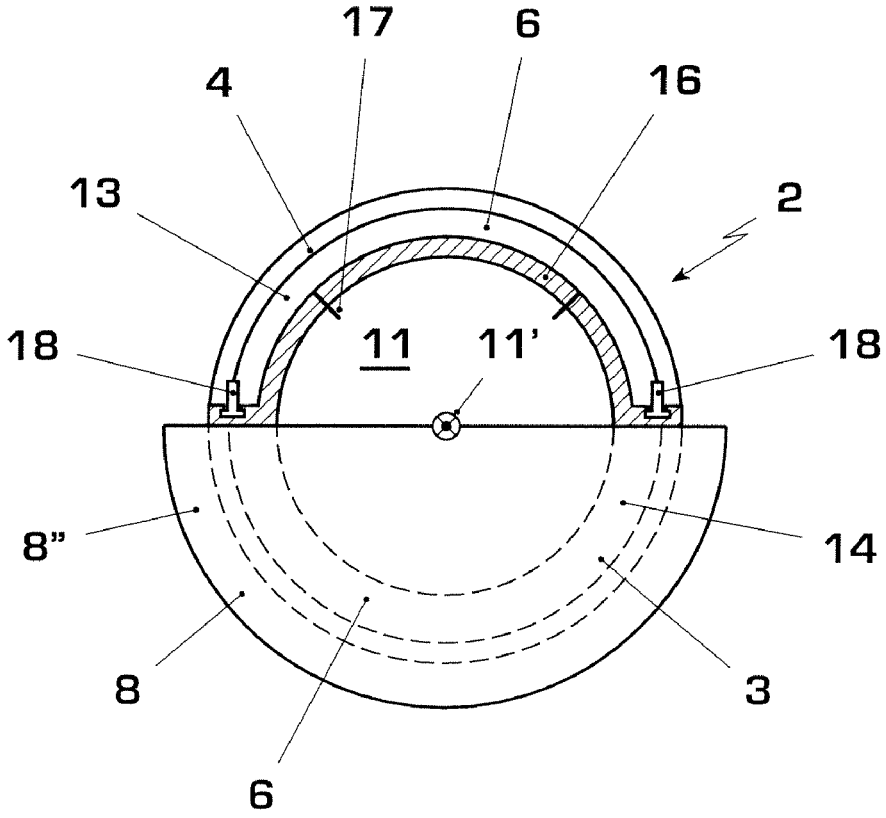
FIG. 4 shows an illustration as in FIG. 3, but with removed top half shell of the outer carrier and with auxiliary tool arranged on the rotor.
Figure 5:
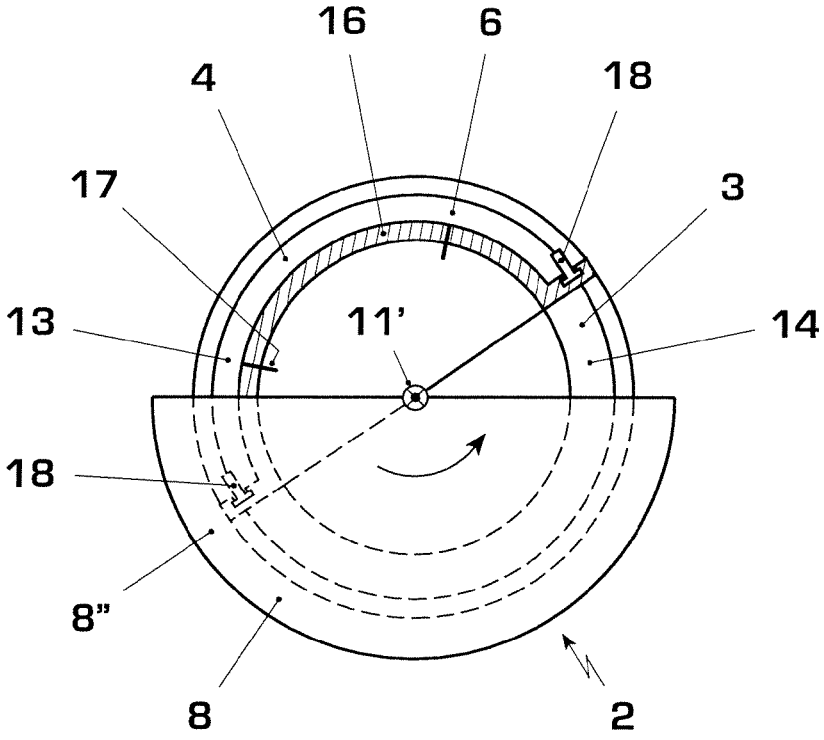
FIG. 5 shows an illustration as in FIG. 4, but with slightly rotated rotor.
Figure 6:
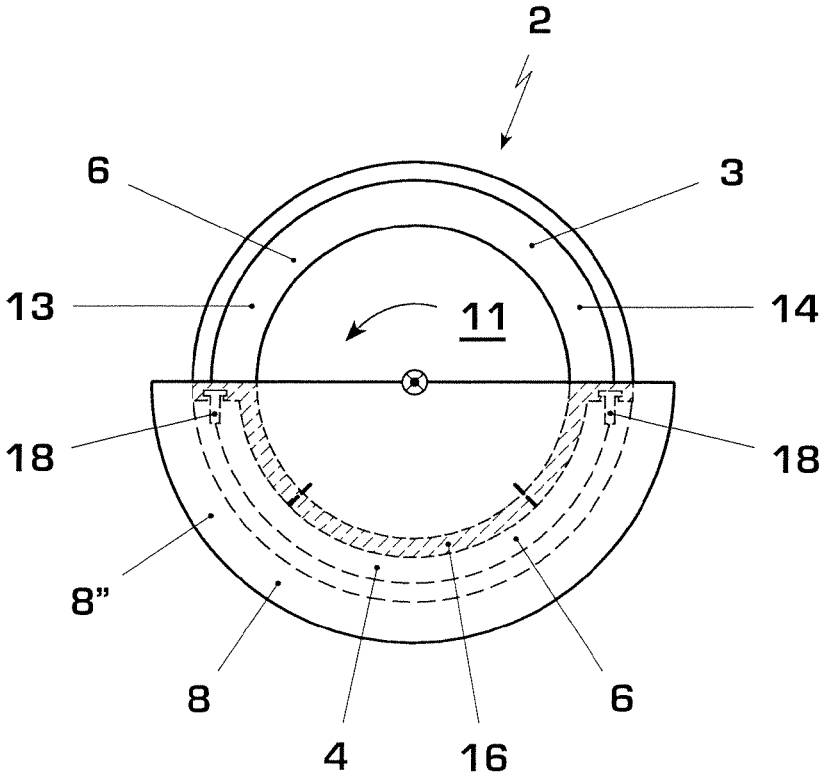
FIG. 6 shows an illustration as in FIG. 4, but with rotor rotated by 180°.

In FIG. 4, the top half shell 15 of the outer carrier 3 has already been removed and an auxiliary tool 16 is connected to the rotor 11 of the turbomachine 2 in a rotationally fixed manner via corresponding connecting means 17. At the same time, the auxiliary tool 16, via axially displaceable adapter slides 18 arranged therein, is connected to the bottom half shell 14 in such a way that the latter can be displaced axially, that is to say out of or into the image plane. This axial displacement of the bottom half shell 14 effects release of the same from the axial connecting contours 7 which are shown in FIG. 1.

Figure 3:
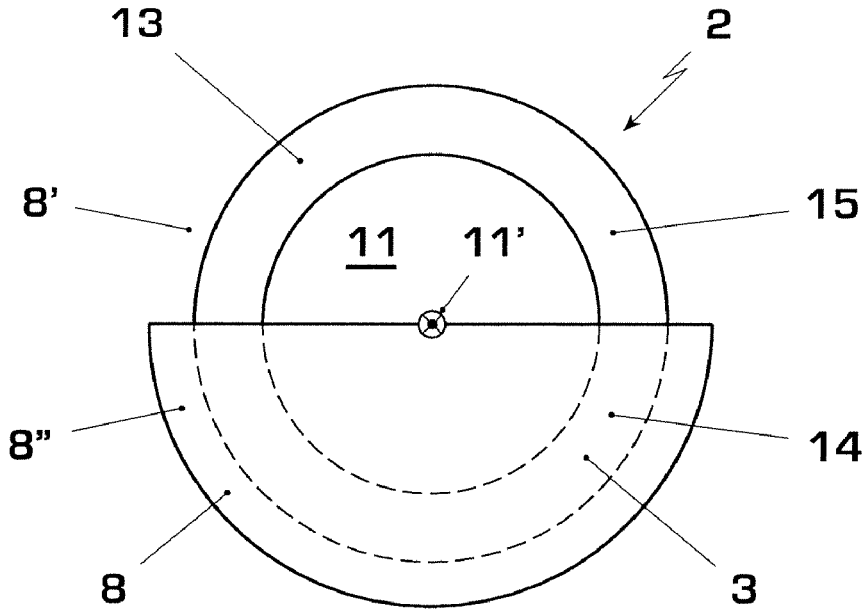
FIG. 3 shows an illustration as in FIG. 2, but with open casing in the region of the combustion chamber and with visible top half shell of the outer carrier.

In the next dismantling step, the bottom half shell 14 is rotated with the rotor 11 by about 180° until the bottom half shell 14 assumes essentially the position of the removed top half shell 15 according to FIG. 3. The rotating operation is in this case shown in FIG. 5. According to FIG. 6, the rotating operation has been completed and the bottom half shell 14 has assumed the position of the top half shell 15 removed beforehand. The bottom half shell 14 rotated upward can now be released from the auxiliary tool 16 and can be removed radially outward, for example by a lifting tool in the form of a crane.

The turbomachine 2 according to exemplary embodiments of the invention and exemplary methods according to the invention for dismantling the outer carrier 3 and/or the inner segment carrier 5 or the front plate 4 have, in this case, several fundamental advantages. The casing 8 only needs to have one maintenance opening in the region of the combustion chamber 1 or merely needs to be designed in such a way that a top casing part 8' is removable. This provides the access to the top half shells 15 of the outer carrier 3, the inner segment carrier 5 and the front plate 4. Due to the design of elements just mentioned, with in each case two shells, namely the bottom half shell 14 and the top half shell 15, the half shells 14, 15 can be removed piece by piece. The half shell 14, which to begin with remains in the bottom casing section 8", can be rotated upward with the rotor 11 by the arrangement and rotationally fixed connection of the auxiliary tool 16 and can then likewise be removed from the casing 8 in a simple manner by means of lifting tools. In addition, by adapter slides 18 being formed on the auxiliary tool 16, which adapter slides 18 can be connected simply and quickly to the respective bottom half shell 14 of the outer carrier 3, of the front plate 4 and of the inner segment carrier 5, an axial displacement of elements just mentioned, and thus release of the same from the connecting contours 7, is possible without any problems. In principle, the elements of the turbomachine 2 are in this case dismantled in the sequence of outer carrier 3, front plate 4 and inner segment carrier 5. Removal of a bottom casing half 8" may in this case be dispensed with in the same way as the removal of the rotor 11.

Due to the exemplary turbomachine 2 according to the invention or the exemplary method according to the invention, the maintenance, that is to say dismantling or exchange and reassembly of the outer carrier 3, the front plate 4 and the inner segment carrier 5, is considerably simplified, as a result of which the maintenance effort and thus also the maintenance costs and associated downtimes of the turbomachine 2 can be markedly reduced.

LIST OF DESIGNATIONS

1 Combustion chamber
2 Turbomachine
3 Outer carrier
4 Front plate
5 Inner segment carrier
6 Coating/heat-resistant layer
7,7' Connecting contour
8 Casing
8' Top casing section
8" Bottom casing section
9 Circumferential groove
10 Circumferential tongue
11 Rotor
11' Rotor axis
12 Connecting contour 7 designed as a step
13 Shell element
14 Bottom half shell
15 Top half shell
16 Auxiliary tool
17 Connecting means
18 Adapter slide While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

What is claimed is:

1. A method of dismantling an element of a turbomachine, the element including an annular shell element including a bottom half shell and a top half shell which can be connected to the bottom half shell, the method comprising:

opening a casing of the turbomachine adjacent to a combustion chamber;

releasing the top half shell from the bottom half shell;

axially displacing the top half shell from a position and thereafter radially removing the top half shell;

rotationally fixedly connecting an auxiliary tool to a rotor of the turbomachine;

connecting the auxiliary tool to the bottom half shell via axially displaceable adapter slides arranged on said auxiliary tool;

axially displacing the bottom half shell to release the bottom half shell from axial connecting contours;

rotating the bottom half shell and the rotor by approximately 180° until the bottom half shell assumes said position of the top half shell; and releasing the bottom half shell from the turbomachine and removing said bottom half shell.

2. The method as claimed in claim 1, where said element comprises an outer carrier, an inner segment carrier, and a front plate.

3. A method of dismantling an element of a turbomachine, the method comprising:

providing a turbomachine comprising a rotor, a combustion chamber including an outer carrier, an inner segment carrier, and a front plate together defining the combustion chamber, the outer carrier, inner segment and front plate comprising connecting contours which are axially releasable from one another, a casing including a closable maintenance opening adjacent to the combustion chamber, which maintenance opening, in an open state, provides access to the outer carrier, the inner segment carrier, and the front plate, wherein the outer carrier, the inner segment carrier, and the front plate comprise annular shell elements, wherein the shell elements each include a bottom half shell and a top half shell which is configured and arranged to be connected to the bottom half shell, and wherein the outer carrier, the inner segment carrier, and the front plate, when in an assembled state, are connected to one another, to the casing, or to both, by the connecting contours;

opening the turbomachine casing adjacent to the combustion chamber;

releasing the top half shell from the bottom half shell;

axially displacing the top half shell from a position and thereafter radially removing the top half shell;

rotationally fixedly connecting an auxiliary tool to the rotor;

connecting the auxiliary tool to the bottom half shell via axially displaceable adapter slides arranged on said auxiliary tool;

axially displacing the bottom half shell to release the bottom half shell from axial connecting contours;

rotating the bottom half shell and the rotor by approximately 180° until the bottom half shell assumes said position of the top half shell; and releasing the bottom half shell from the turbomachine and removing said bottom half shell.

4. The method as claimed in claim 2, further comprising:

sequentially dismantling the outer carrier, the front plate, and the inner segment carrier.

* * * * *